United States Patent [19]

Beckley

[11] 4,146,269

[45] Mar. 27, 1979

[54] KNOCKDOWN FURNITURE STRUCTURE

[76] Inventor: Charles R. Beckley, 2708 Woodley Pl., NW., Washington, D.C. 20008

[21] Appl. No.: 877,994

[22] Filed: Feb. 15, 1978

[51] Int. Cl.[2] ..... A47C 7/00

[52] U.S. Cl. ..... 297/440; 108/153; 297/441; 297/461; 403/217

[58] Field of Search ..... 297/441, 440, 461, 462, 297/440; 108/153, 156, 111; 403/217, 219, 375, 378, 258, 264, 296; 52/585, 280; 248/165

[56] References Cited

U.S. PATENT DOCUMENTS

| | | | |
|---|---|---|---|
| 233,478 | 10/1880 | Creager | 297/456 |
| 719,837 | 2/1903 | Morton | 248/165 |
| 1,391,362 | 9/1921 | Bickel | 297/416 |
| 1,734,340 | 11/1929 | Overton | 403/258 X |
| 1,813,072 | 7/1931 | Murdock | 403/219 X |
| 2,699,816 | 1/1955 | Gittings et al. | 297/441 |
| 3,118,543 | 1/1964 | Dresdner | 211/182 X |
| 3,379,474 | 4/1968 | Schwarz, Jr. | 297/441 |
| 3,608,966 | 9/1971 | Kredenser | 297/441 X |
| 3,643,997 | 2/1972 | Gilbert et al. | 297/441 |
| 3,727,981 | 4/1973 | Ostroff | 297/440 |
| 3,730,109 | 5/1973 | Kreizel | 108/156 |
| 3,837,754 | 9/1974 | Malcik | 403/217 |
| 3,856,345 | 12/1974 | Beckley | 297/16 |
| 3,907,362 | 9/1975 | Zerlaut | 297/440 |
| 3,909,064 | 9/1975 | Payne, Jr. et al. | 297/440 |
| 3,950,028 | 4/1976 | Schnepel | 297/445 |
| 3,977,721 | 8/1976 | Peterson | 297/45 |
| 4,043,591 | 8/1977 | Lehmann | 297/440 X |

*Primary Examiner*—James T. McCall
*Attorney, Agent, or Firm*—Bacon & Thomas

[57] ABSTRACT

A furniture support structure includes a pair of front legs and a pair of rear legs each having bore holes therein for receiving rungs that extend therebetween. The pairs of legs are locked together by rungs in the form of dowels which have grooves adjacent the ends thereof through which pass screws that register with threaded inserts in front and rear rungs which extend between the front legs and the rear legs respectively. In a preferred embodiment, the furniture support structure is used to form a seat in which an additional pair of dowels extend between the front and rear pairs of legs and support a trapezoidal-shaped web extending therebetween. In order to absorb the force applied to the structure when a person sits in the seat, the front legs and rear legs are held spaced apart by front and rear dowels. If the seat is to be configured as a chair, or the like, the rear legs extend above the front legs to support a back panel. If the seat is configured as an ottoman then the sling is preferably rectangular and the rear and front legs have the same height.

15 Claims, 10 Drawing Figures

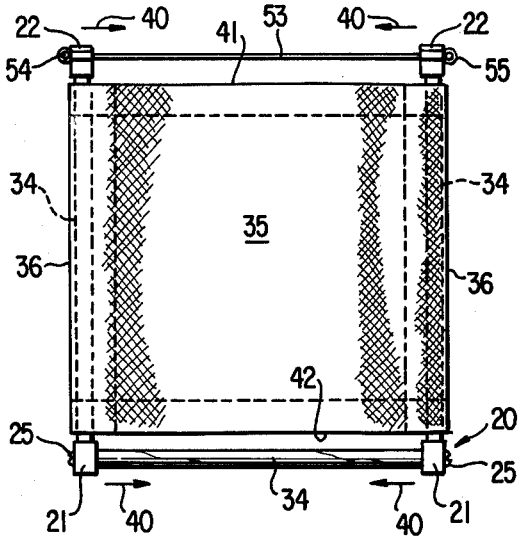
FIG. 1
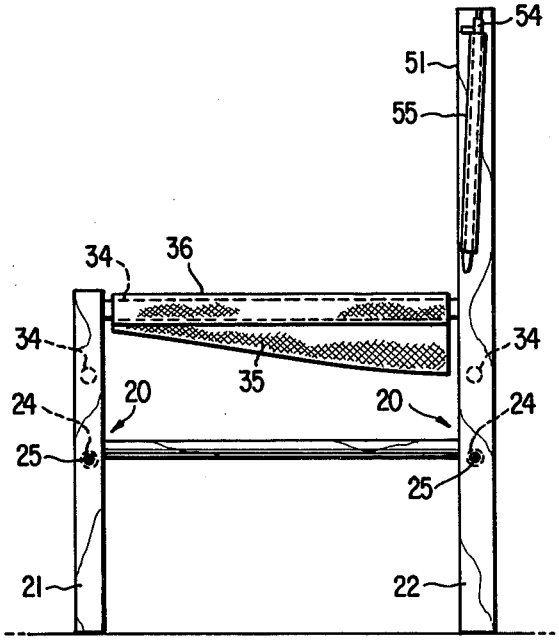
FIG. 3
FIG. 2
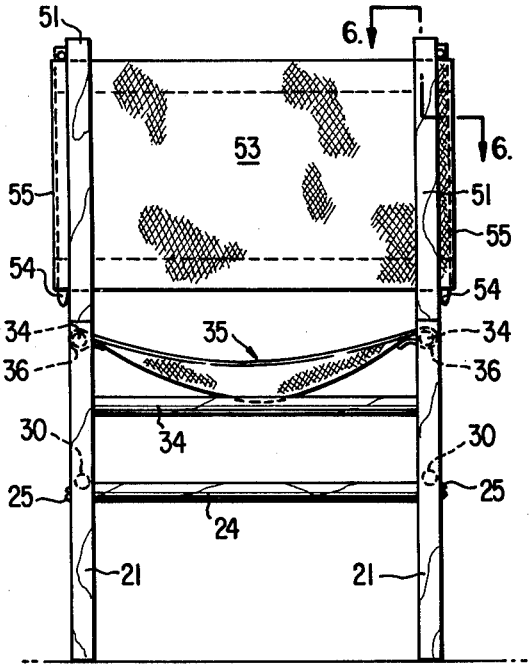
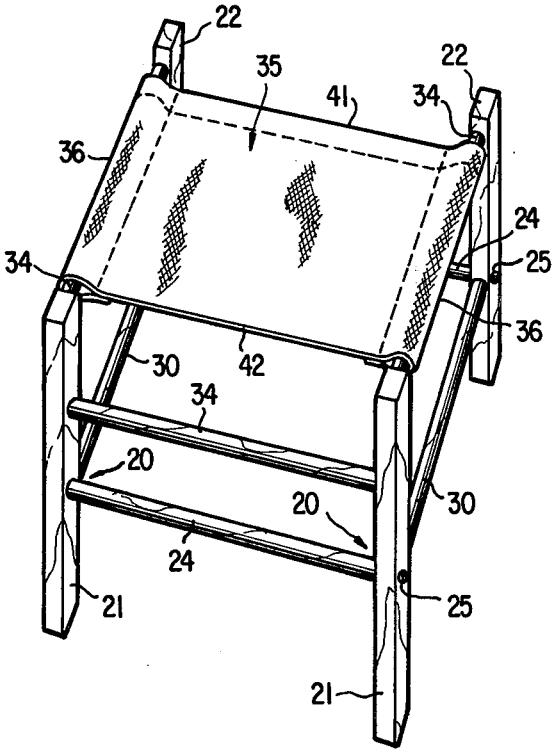
FIG. 10
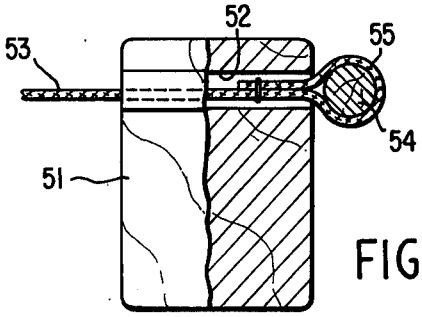
FIG. 6

FIG.7
FIG.4
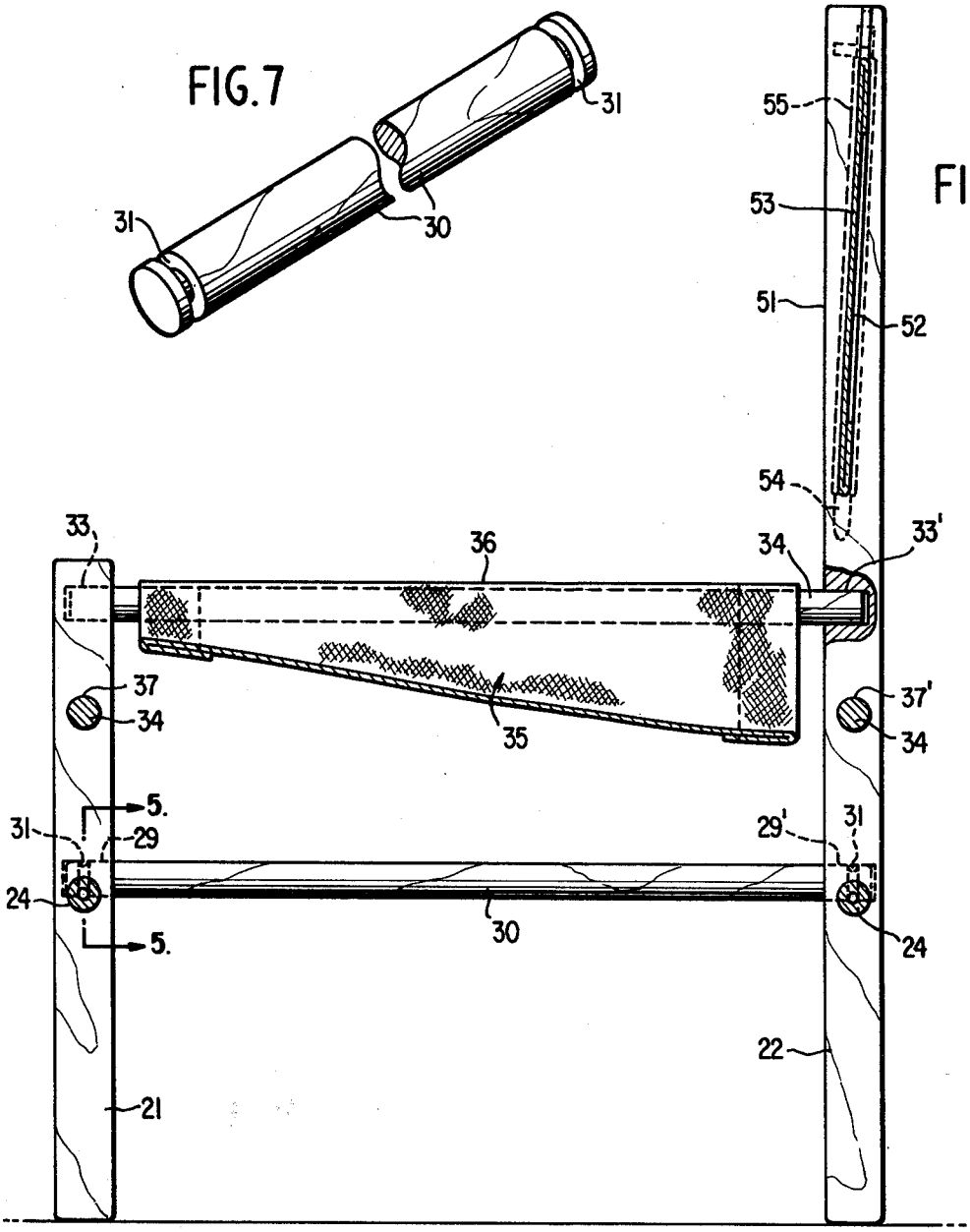
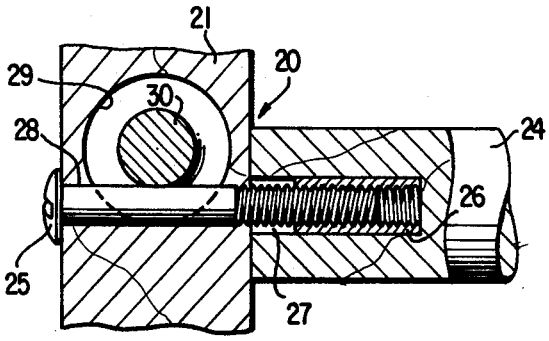
FIG.5
FIG.8
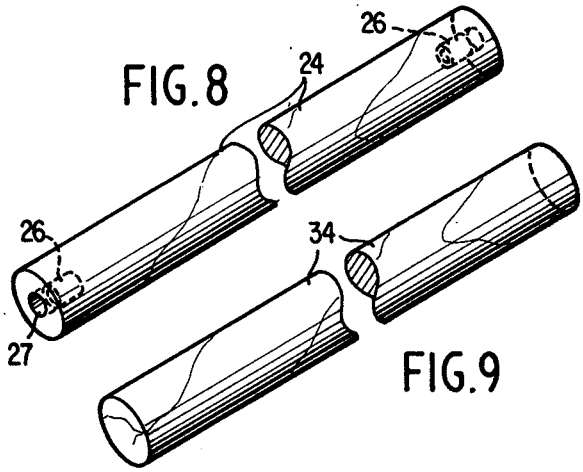
FIG.9

KNOCKDOWN FURNITURE STRUCTURE

BACKGROUND OF THE INVENTION

1. Field of the Invention

This invention relates to furniture support structures, and more particularly, it relates to furniture support structures of the knockdown type which may be readily assembled and disassembled.

2. Technical Considerations and Prior Art

In recent years, knockdown furniture has become increasingly popular with both consumers and manufacturers. Generally, knockdown furniture is shipped from a manufacturer in a disassembled state and is sold to retail customers while still disassembled. Preferably, the furniture is relatively simple and the retail customer can quickly assemble the furniture at home. If the customer wants to thereafter disassemble the furniture for transport or storage he can easily disassemble it. Most knockdown furniture structures are somewhat complex and require relatively expensive manufacturing techniques in order to produce parts which are interchangeable and which are consistent enough in quality so that each article of furniture need not be assembled before being shipped in order to determine if the pieces fit together properly. Therefore there is a need for knockdown furniture in which the various parts are simple to manufacture and in which the manufacturer can have confidence that the parts will always fit together properly. Furthermore, if the parts are easy to cut and are made from standard stock, the expense of the furniture can be kept to a minimum.

OBJECT OF THE INVENTION

With the foregoing considerations in mind it is an object of the instant invention to provide a new and improved knockdown furniture support structure.

It is an additional object of the invention to provide a new and improved knockdown furniture support structure which is economical to manufacture and easy to assemble.

It is a further object of the instant invention to provide a furniture support structure which is readily usable to construct a chair or ottoman.

It is still another object of the instant invention to provide a new and improved furniture support structure for knockdown furniture which utilizes readily available, precut, stock material.

It is still a further object of the instant invention to provide a furniture support structure for knockdown furniture wherein the materials may be cut and bored automatically with a minimum of effort and expense.

SUMMARY OF THE INVENTION

With the foregoing objects in mind the instant invention contemplates a furniture support structure comprising pairs of front and rear legs wherein the front and rear legs have bores facing one another for receiving dowels therein. The dowels have grooves adjacent the ends thereof which are received in the bores. Relatively small diameter bores are registered with the bores receiving the dowels and screws are passed through the relatively small diameter bores and through the grooves to hold the dowels in place. The screws are threadably received in front and rear rungs which hold the front legs separate from one another and the rear legs separate from one another. By utilizing the aforerecited structure, a relatively rigid frame is provided which may conveniently support the seat to provide a chair or ottoman.

BRIEF DESCRIPTION OF THE DRAWINGS

FIG. 1 is a top view of the furniture support structure of the instant invention embodied in a chair;

FIG. 2 is a front view of the chair of FIG. 1;

FIG. 3 is a side view of the chair of FIG. 1;

FIG. 4 is an enlarged side view of the chair of FIG. 1, partially in section;

FIG. 5 is an enlarged view taken along lines 5—5 of FIG. 4 showing a joint which is used with the furniture support structure of the instant invention;

FIG. 6 is an enlarged sectional view taken along lines 6—6 of FIG. 2, showing how a seat back may be attached to the structure of the instant invention;

FIG. 7 is a perspective view of one type of dowel utilized with the structure of the instant invention wherein the dowel is used as a bottom side rung connecting front and rear pairs of legs;

FIG. 8 is a perspective view of a dowel used as a front and rear lower rung adjacent the dowel of FIG. 7;

FIG. 9 is a perspective view of a dowel used as an upper side rung to support a sling seat and as an upper front rung and upper rear rung to help rigidify the furniture support structure; and FIG. 10 is a perspective view of the furniture support structure configured as an ottoman.

DETAILED DESCRIPTION OF THE PREFERRED EMBODIMENT

Referring now to the drawings, there is shown a joint 20 in FIG. 5 which is used to hold front and rear pairs of legs 21-21 and 22-22 in fixed spaced relation relative to one another. As is seen in FIGS. 1–4, the joint 20 is used in a furniture support structure configured as a chair, and as seen in FIG. 10 the joint 20 is used in a somewhat similar furniture support structure configured as an ottoman.

The joint 20 shown in FIG. 5 joins a dowel 24 to a front or rear leg 21/22 with a screw 25 that is received within a threaded insert 26 seated in a bore 27 in the dowel 24. The screw 25 passes through a bore 28 in the front or rear leg 21/22 that is in turn registered with a relatively large diameter bore 29 at right angles thereto. As is seen in FIGS. 4 and 5 the bore 28 passes beneath the axis of the bore 29. A dowel 30 is received in the bore 29 and has circular slots or grooves 31 adjacent the ends thereof. The screw 25 passes through one of the grooves 31 to hold the dowel 30 within the bore 29. In assembling the joint, dowel 30 is first inserted into the bore 29 and then screw 25 is passed through the bore 28 and the groove 31 before being threaded into the insert 26. In this way, an orthogonal joint is created in which the dowels 24 and 30 are perpendicular to one another as well as to the leg 21/22 to which they are joined.

The applicant uses this particular joint to assemble a chair (FIGS. 1–4) or ottoman (FIG. 10), however, the joint may be used with other types of furniture support structures such as tables, stands or the like.

In using the joint 20 with a chair or ottoman the dowel 24 serves as a lower side rung while the dowel 30 serves as a lower front or rear rung. In the preferred embodiment, the front legs 21 have rearwardly facing bores 29 while the rear legs 22 have frontwardly facing bores 29'. The bores 29 and 29' do not extend completely through the leg but bottom therein. As is seen in FIG. 4, the front and rear pairs of legs 21-21 and 22-22 also have top rearwardly and forwardly facing bores 33 and 33' which receive dowels 34 (see FIG. 9) therein which support a fabric sling 35. The dowels 34 simply seat within the bores 33 and 33' and are not held therein by any positive means such as a screw or interlocking structure.

In assembling the chair, the dowels 30 and 34 which form top and bottom side rungs are first inserted into the back legs 22-22 of the chair and the sling 35 is slid over the dowels 34 which pass through loops 36 stitched on opposite sides of the sling. The front legs 21 are then mounted on the rungs 30 and 34 and pressed into place so that the rungs hit the bottoms of bores 33, 33' and 29, 29'.

In order to both lock the dowels 30 and 34 in place and to separate the front legs 21 from one another and the rear legs 22 from one another, dowels 34 are inserted in bores 37 and 37' which are located above the bores 29 and 29'. As with the bores 29, 29', 33 and 33', bores 37 and 37' do not pass completely through the legs 21 and 22, but rather bottom within the legs. Dowels 34 are inserted into the bores 37 and 37' to form top front and rear rungs which seat within the bores. A dowel 24 is then placed between the rear legs 22 with the bores 27 in opposite ends of the dowel aligned with bores 28 and the rear legs 22. A screw 25 is then passed through each bore 28 and screwed into one of the inserts 26 to retain both the rung 24 and the rung 30 in place as previously described. The same procedure is followed with another dowel 24 which provides a lower front rung for the front pair of legs 21. Upon tightening the screws 25 a rigid furniture support structure is obtained in which sling 35 forms a seat.

As seen in FIGS. 1 and 2, when a load is placed in the sling 35 there is a tendency to rotate the front and rear legs toward one another in the direction of arrows 40. This tendency is absorbed by the top front and rear rungs provided by dowels 34 which are under compressive stresses when the sling 35 is loaded. The tendency is for the legs 21-21 and 22-22 to rotate about the joints 20, however this tendency is absorbed by the front and rear top rungs 34.

In order to provide a comfortable seat, the sling 35 has a generally trapezoidal configuration wherein it is wider at the rear edge 41 than at the front edge 42. Consequently, the seat slopes slightly toward the rear providing a concave rearwardly sloping seat. As seen in FIGS. 2 and 3, the front rung 34 is beneath the front edge 42 of the sling so that ones legs do not rest upon the front rung 34.

If one desires to use the structure as an ottoman as shown in FIG. 10 then the sling 35 may preferably be square so that the front and rear edges 41 and 42 have the same length. In the ottoman embodiment of FIG. 10 the rear legs are simply cut off at the same height as the front legs.

In the chair embodiment of FIGS. 1-4, the rear legs extend above the front legs to form back supporting struts 51 which have slots 52 therein that receive a rectangular fabric panel 53. The fabric panel 53 is held within the slots by dowels 54 which pass through loops 55 stitched on opposite edges of the fabric.

As is readily seen in FIGS. 7, 8 and 9 the rungs from which this furniture structure is made are dowels which may of course be of standard sizes. As seen in FIG. 7, the dowels 30 are altered by cutting circular slots or grooves 31 adjacent the ends thereof and the dowels 24 are altered by fitting them with threaded inserts 26. The dowels 30 and 34 are mounted in bores 29, 33 and 37 which are easily drilled in the legs 21 and 22. It is therefore readily seen that the furniture support can be easily and inexpensively manufactured and can be quickly assembled by an average customer using only a screwdriver.

The foregoing embodiments are merely illustrative of the invention which is limited only by the following claims.

I claim:

1. A furniture support structure comprising:

a pair of front legs each having a first rearwardly facing bore therein and a relatively small diameter bore registered with the rearwardly facing bore at an angle thereto;

a pair of rear legs each having a first frontwardly facing bore therein and a relatively small diameter bore registered with the rearwardly facing bore at an angle thereto;

side rung means extending between the front pairs of legs and rear pairs of legs wherein said rung means seat within said first rearwardly and frontwardly facing bores to hold said front and rear legs in spaced relation to one another, said side rungs having slots adjacent the ends thereof for positioning in said first rearwardly and frontwardly facing bores wherein said slots align with said relatively small diameter bores;

first front and rear rung means aligned with said relatively small diameter bores to hold the front legs in spaced relation to one another and the rear legs in spaced relation to one another; and fastening means extending through said relatively small diameter bores and through the slots adjacent the ends of said side rung means to retain said side means in said first rearwardly and frontwardly facing bores, said fastening means engaging said first front and rear rung means to hold said front and rear first rung means between the respective pairs of legs to thereby provide a rigid furniture structure support.

2. The furniture support structure of claim 1 further including:

sidewardly facing bores in said front and rear legs, wherein said sidewardly facing bores are positioned above said first rearwardly and frontwardly facing bores;

second front and rear rung means registered in said sidewardly facing bores;

second rearwardly and frontwardly facing bores in said front and rear legs positioned above said sidewardly facing bores;

second side rung means registered in said second rearwardly and frontwardly facing bores; and a sling seat extending between and supported by said second side rung means wherein when weight is placed upon the sling the front legs tend to rotate one side rung toward one another to compress the second front rung while the rear legs tend to rotate about the other first side rung toward one another to compress the second rear rung.

3. The furniture support structure of claim 2 wherein the sling is trapezoidal in shape having two equal side edges and a rear edge which is longer than the front edge so that when the side edges are supported by the second side rungs the rear edge hangs lower than the front edge forming a concave seat which slopes downwardly toward the rear legs.

4. The furniture support structure of claim 2 wherein the rear legs project above the sling to form a support for a chair back which is attached to the rear legs above the sling.

5. The furniture support structure of claim 4 wherein the chair back is a fabric panel.

6. The furniture support structure of claim 1 wherein the rungs are dowels and wherein the rearwardly and frontwardly opening bores extend partially into said legs and have a diameter substantially the same as the dowels so that the dowels seat snugly therein.

7. The furniture support structure of claim 6 wherein the slots in the first side rungs are grooves extending around the rungs.

8. The furniture support structure of claim 7 wherein the fastening means are screws which threadably engage threaded inserts mounted within the first front and rear rungs to hold the first front and rear rungs in abutment with the legs.

9. The furniture support structure of claim 2 wherein all of the rungs are dowels and wherein the bores receiving the rungs extend partially into the legs and have a diameter substantially the same as the rungs so that the rungs snugly fit and bottom within the bores.

10. The furniture support structure of claim 9 wherein the fastening means are screws which threadably engage threaded inserts mounted within the first front and rear rungs to hold the first front and rear rungs in abutment with the legs.

11. The furniture support structure of claim 10 wherein the front and rear legs are of the same height so as to form an ottoman.

12. A furniture support structure comprising:

a first pair of legs;

a second pair of legs;

first opposed bores in the first pair of legs and in the second pair of legs;

relatively small diameter bores registered with each first bore;

first rung means extending between the first and second pairs of legs wherein the rung means seat within the first opposed bores to hold the first and second pairs of legs in spaced relation to one another, the first rung means having slots adjacent the ends thereof for positioning in the first bores wherein the slots align with the small diameter bores;

second rung means aligned with the relatively small diameter bores to hold the individual pairs of legs in spaced relation to one another; and fastening means extending through the relatively small diameter bores and through the slots adjacent the ends of the first rung means to retain the first rung means in the opposed bores, the fastening means engaging the second rung means to hold the second rung means between the respective pairs of legs to thereby provide a rigid furniture support.

13. The furniture support structure of claim 12 wherein the rungs are dowels and wherein the opposed bores extend partially into the legs and have a diameter substantially the same as the dowels so that the dowels seat snugly therein.

14. The furniture support structure of claim 13 wherein the slots in the first side rungs are grooves extending around the rungs.

15. The furniture support structure of claim 14 wherein the fastening means are screws which threadably engage threaded inserts mounted within the first rung means to hold the first rung means in abutment with the legs.

* * * * *